United States Patent [19]

Thorsnes

[11] Patent Number: 5,016,411

[45] Date of Patent: May 21, 1991

[54] BUILDING STRUCTURE AND METHOD AND ELEMENT FOR MAKING SAME

[75] Inventor: Ola O. Thorsnes, Oslo, Norway

[73] Assignee: A/S Selvaagbygg, Oslo, Norway

[21] Appl. No.: 469,534

[22] PCT Filed: Sep. 23, 1988

[86] PCT No.: PCT/NO88/00070

§ 371 Date: Mar. 16, 1990

§ 102(e) Date: Mar. 16, 1990

[87] PCT Pub. No.: WO89/02959

PCT Pub. Date: Apr. 6, 1989

[30] Foreign Application Priority Data

Sep. 24, 1987 [NO] Norway ..... 874020

[51] Int. Cl.[5] ..... E04B 5/48

[52] U.S. Cl. ..... 52/220; 52/336; 52/450; 52/743

[58] Field of Search ..... 52/220, 221, 334, 336, 52/450, 799, 741, 743

[56] References Cited

U.S. PATENT DOCUMENTS

| | | | |
|---|---|---|---|
| 3,245,186 | 4/1966 | Jentoft | 52/334 |
| 3,812,636 | 5/1974 | Albrecht et al. | 52/336 X |
| 3,849,957 | 11/1974 | Bastgen | 52/336 X |
| 4,120,131 | 10/1978 | Carroll | 52/336 X |
| 4,125,977 | 11/1978 | Michlovic | 52/220 |
| 4,529,051 | 7/1985 | Stolz et al. | 52/336 X |
| 4,630,414 | 12/1986 | Ting | 52/220 |

*Primary Examiner*—Philip C. Kannan

*Attorney, Agent, or Firm*—Morgan & Finnegan

[57] ABSTRACT

A building structure comprises two parallel plates (2, 3) attached to means (4) therebetween forming channels (5, 6). Some of these channels are filled with concrete so that concrete ribs (10, 11) are formed, which preferably are provided with reinforcement (12). This building structure will in many cases be provided with a cover (9) of concrete. In order to form a connection between the cover and the concrete ribs (10, 11), holes (13) are made in one of the plates (3) in order for a monolithic connection to be formed between the ribs and the concrete. A shear force reinforcement (15) may be placed into the ribs (10) though the holes (13). The plates (2, 3) with the channel forming means (4) constitute a prefabricated element (1) which is brought to the building site without holes (13) in said one plate. However, the plate is provided with hole markings (8), but the holes are only made at the building site when it has been determined which of the channels (5) are to be filled with concrete in the particular use at hand. Since the plate (3) in this manner is not provided with more holes than necessary, the plate (3) retains sufficient strength in order for the element (1) to have sufficient rigidity and strength to withstand traffic loads and the weight of the concrete before it has hardened.

12 Claims, 2 Drawing Sheets

BUILDING STRUCTURE AND METHOD AND ELEMENT FOR MAKING SAME

The present invention relates to a building structure, comprising a first plate and means attached thereto forming parallel channels, of which at least some are filled with concrete forming ribs.

Floors and walls—and particularly wooden floors often have such a low stiffness that they vibrate under dynamic loads. Several attempts have been made to reinforce and stiffen such floors but without technically and economically satisfactory results.

It is known to use corrugated steel plates as bottom in forms for pouring concrete floors. The upwardly concave portions of these plates become filled with concrete during the pouring and therefore form stiffening ribs depending on the bottom side of the floor, while the steel plate itself becomes an integral part for the concrete floor and forms a reinforcement thereof.

It will be understood that such corrugated steel plates have relatively low stiffness, particularly transversally of the longitudinal direction of the corrugations, a fact requiring particular considerations regarding both support and loading, e.g. traffic by persons and equipment, before the concrete is poured. The concrete will fill all upwardly open corrugations so that the concrete-filled ribs usually will be placed relatively close to each other and the floor will be correspondingly heavy. Furthermore, the center of gravity of the corrugated plate will be situated midway between the top and bottom of the corrugations, which leads to the fact that the reinforcement constituted by the steel in the plate will not have the optimum position near the bottom of the ribs. Since the corrugated plate forms an integral part of the concrete floor, it will not have appreciable sound dampening properties.

In order to alleviate some of these drawbacks, one has provided the corrugated plate with a plane steel plate on the bottom side. Such a plate is known e.g. from U.S. Pat. No. 4,630,414, FIG. 3. However, neither this plate does not solve the above-mentioned problems in a satisfactory manner, and it is relatively expensive.

One of the objects of the present invention is thus to provide a building structure of said type, which to a large extent avoids the drawbacks and deficiencies mentioned above.

According to the invention this is obtained by the building structure comprising a second plate which is parallel to the first plate and also is attached to the channel forming means, the plates being substantially continuous and the ribs being provided with reinforcements in any portion subjected to high tensile loads.

By employing two plates being substantially continuous one is able to obtain a relatively stiff structure even with the use of inexpensive materials. The two plates also ascertain that the channels are covered on both sides, thus providing control with the channels to be filled with concrete. This permits limiting the number of stiffening and reinforcing ribs to the extent necessary for the use at hand, thus saving both weight and cost. Such light structures may be used e.g. in roofs and walls.

If the building structure is to be used as flooring, it is suggested according to the invention that the second of the two plates be provided with a cover of concrete, the concrete in the cover and in the ribs being in communication with each other through holes taken out in the second plate so that a monolithic connection is formed between the ribs and the cover. Also in this case one has full control with the number of channels which are filled with concrete for the formation of ribs. This entails that the distance between the plate and the heigth of the ribs may be made relatively large, so that the effect of the ribs becomes correspondingly larger and the necessary number of ribs becomes correspondingly smaller. In the event that the channels are formed by a corrugated element between the plates, it will not be necessary to pour concrete in more than one third of the channels even in strongly loaded floors.

One has found that a building structure according to the invention gives surprisingly low sound transmission numbers. One is not certain why this is so, but assumes that some of the explanation may be that the concrete part on the one side and the opposite plate with the empty channels on the other side, form two structures with very different natural frequencies.

According to the invention it is also provided a method for making a building structure of the above-mentioned type. This method is characterized by prefabricating an element essentially being comprised by two parallel plates attached to means in between forming channels, holes being taken out in one of the plates with a predetermined spacing along some of the channels, and reinforcements being placed in these channels, which then are filled with concrete.

By such a method the elements may be prefabricated in a factory without regard to their later use because one does not have to determine the number of channels to be filled with concrete and the holes to be taken out for this purpose before the element has arrived at the building site or has been placed in its final location in the building of which it forms a part. This of course simplifies production, storage and handling of the elements, with resulting cost savings.

If the prefabricated element is to be provided with a concrete cover, it is advantageous in accordance with the method of the invention that the concrete be poured in the respective channels concurrently with pouring the cover. This ensures a good connection between the cover and the concrete ribs formed in the channels. If the area represented by the holes in the plate facing the cover should not be sufficient to provide the necessary shearing force transmission in particular uses, it is suggested according to the invention to arrange shearing force reinforcement in the holes before pouring the concrete.

The invention further relates to an element for performing the above method. This element is characterized in that it comprises two parallel plates, which are attached to means in between forming channels, in that the plates are made of materials chosen from the group comprising gypsum, fiber composits, wood or cement-based materials, preferably gympsum boards, and in that the channel forming means are made of materials chosen from the group comprising wood, cardboard, plastic or metal, preferably corrugated cardboard.

In order to simplify making the holes in one of the plates and to ensure that the holes are not located in places where they may damage the channels or weaken the element to a harmful degree, it is suggested according to the invention to provide the plate in question with weakenings or markings for forming the holes with a predetermined spacing along at least some of the channels.

Furthermore, it is suggested according to the invention to provide the element with elements of wood along at least two of its edges. This will reinforce the edges and make it easier to transport and handle the element without subjecting it to damage.

In order for the better understanding of the invention it will be described more closely with reference to the exemplifying embodiments shown in the appended drawings.

In the various figures like parts are given the same reference numerals.

Figure 1:
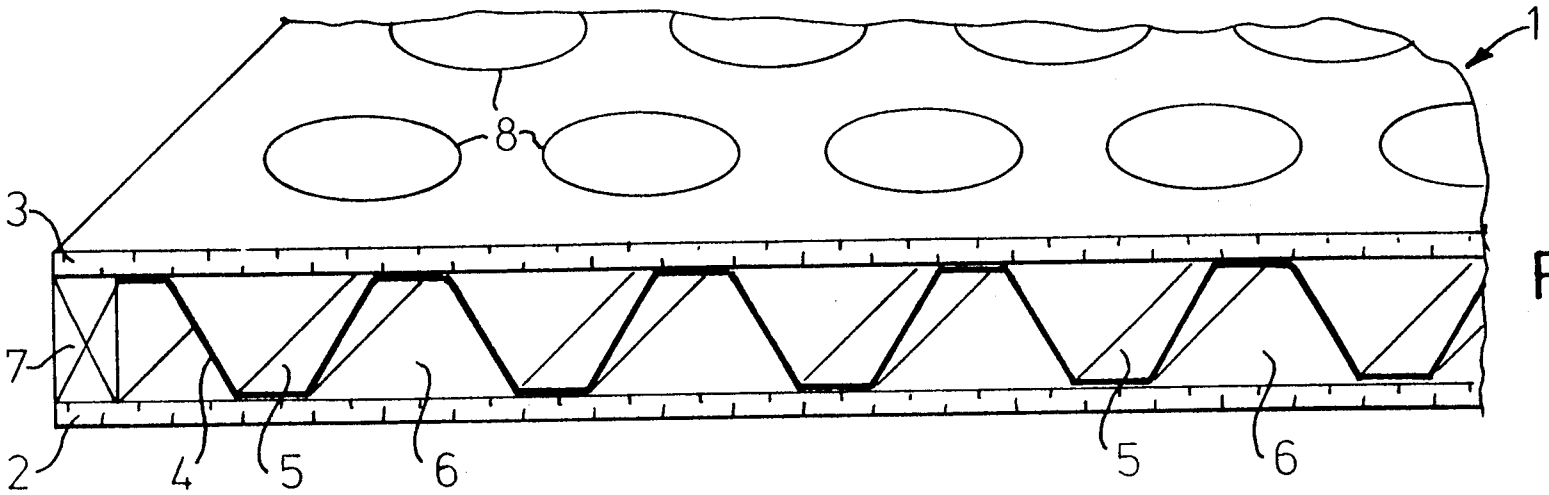
FIG. 1 shows isometrically a portion of an element according to the invention.

It is first referred to FIG. 1, which shows a corner section of a prefabricated element generally designated 1. The element comprises two parallel, plates 2, 3, e.g. gypsum boards, which are held spaced apart by means of a channel forming element 4 in the form of a folded plate of corrugated cardboard. The plate 4 forms upwards and downwards facing ridges which are glued to a respective one of the plates 3 and 2, so that these together form a rigid element. The folded plate 4 further forms a number of upwards and downwards facing channels 5 and 6, respectively, which are closed by the plates 3 and 2, respectively. At their outer longitudinal edge the plates 2, 3 are provided with an element 7 of wood, which reinforces the edge section and also forms distance means.

The plate 3 is provided with circular hole markings 8 placed with equal spacing opposite the channels 5. Corresponding markings may be arranged in the plate 2 opposite the channels 6. When using the element 1 one can choose which of the plates 2, 3 is to face upwards, depending on how near the edge element 7 one wishes the first channel filled with concrete.

Figure 2:
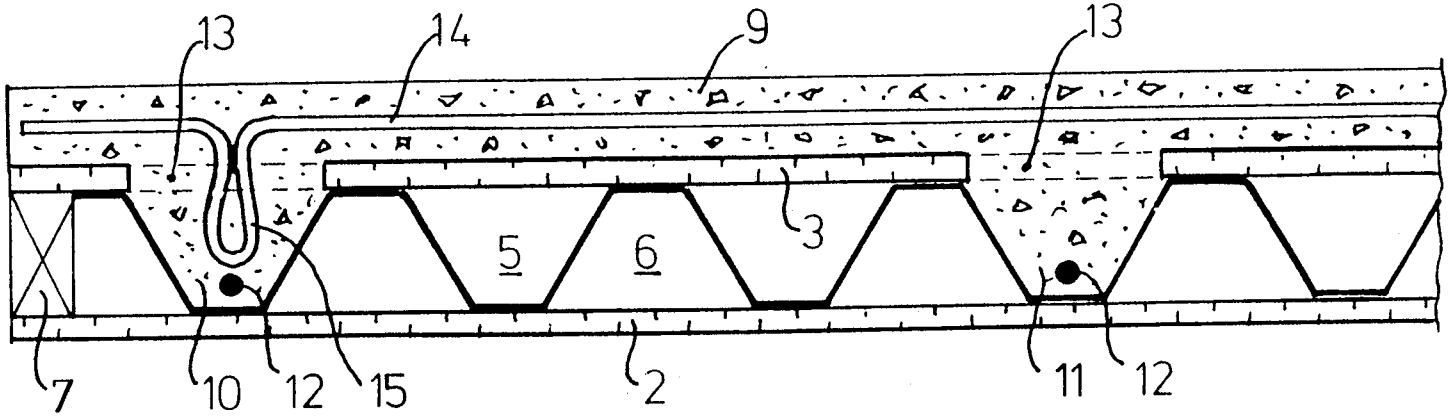
FIG. 2 shows a section through the element in FIG. 1 after providing it with a cover of concrete.

FIG. 2 shows a section through the element 1 after it has been provided with a concrete cover 9 and two of the channels 5 have been filled with concrete so as to form ribs 10, 11. These ribs are provided with steel reinforment 12 near the bottom.

Pouring concrete into the ribs 10, 11 has taken place after holes 13 have been made in the plate 3 of the element 1 where markings 8 are shown in FIG. 1. The cover 9 is provided with a secondary reinforcement 14. In case the shearing forces to be transmitted between the cover and rib are large, a shearing force reinforcement 15 is placed into the rib through the hole 13, as shown for the rib 10. Here the shearing force reinforcement 15 is shown as a bent down portion of the secondary reinforcement 14, but the shearing force reinforcement may of course take any other suitable form.

Figure 3:
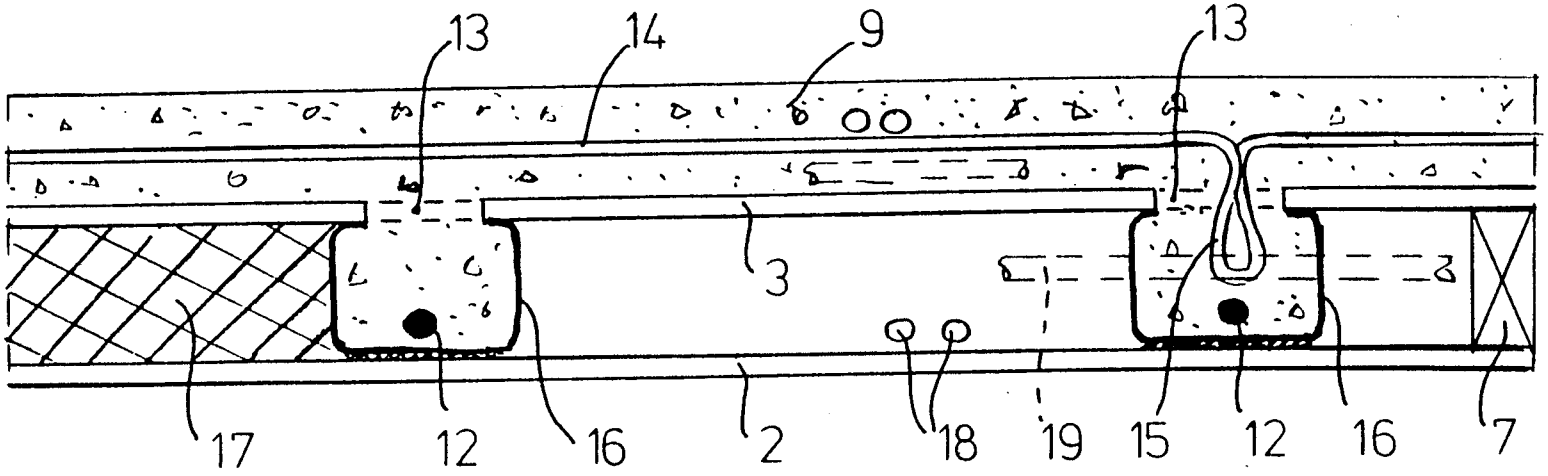
FIG. 3 shows an alternative embodiment in section similar to FIG. 2.

In FIG. 3 one of many possible alternative embodiments of the building structure according to the invention is shown. Here, the channels to be filled with concrete are formed by elongate, boxlike elements made from e.g. sheet metal or plastic. These channel elements are glued or attached by mechanical means to the plates 2, 3. The channels may also be envisioned to take other forms. For example they may be limited sideways by parallel wooden battens, or by means of generally U-shaped sheet metal sections placed edgeways with the flanges facing away from each other. If the channel limiting means do not withstand moisture, the channels may be clad internally with a suitable foil.

FIG. 3 also shows how the spaces delimited by the plates 2, 3 and channels may be filled with insulating material 17. Likewise, pipes 18 are shown for electric power or water. Corresponding pipes may also be placed in the cover 9. Pipes extending transversally of the channels, as indicated by 19, may also be used if they are brought in place during the manufacture of the element 1. These pipes should preferably be placed between the hole markings 8.

It will be understood that the invention is not limited to the exemplifying embodiments shown, but may be varied and modified in a number of ways, both with regard to design and use. Thus, the element 1 may find use without concrete in the channels, such as in lightly loaded structures like ceilings and light walls. In other words, it is not necessary to utilize the elements in a horizontal position. By standing the elements on edge (with the channels vertical) the element may be used in supporting walls if the necessary number of channels are filled with concrete. In external walls or foundation walls, the concrete may afterwards be applied on the outside. When using the elements in sloping roofs, wherein some of the channels are filled with concrete, attachment means for laths and battens may advantageously be cast into the ribs through the holes in the upper plate of the element.

It will also be understood that the building structure according to the invention may be insulated in a large number of ways. Not only may the insulating material be placed in the channels of the element, as shown in FIG. 3, but the insulation may also be placed between the upper plate and the concrete cover or on the bottom side of the element. Furthermore, the channels to be filled with concrete may first be lined entirely or in part with insulating material. Particularly in embodiments where the empty channels are filled with insulating material, it may be suitable to line the bottom with insulating material in those channels which are to be filled with concrete.

The element according to the invention may also advantageously be made with ribs in two or more directions by forming the channel forming means as a grating of channels and/or cells. In this manner the stiffness of the element may by increased in several directions.

The choice of material for the plates of the element may be adapted to the use of the element. Gypsum boards have proven suitable in many connections, but also other materials like particle boards or composits of gypsum and chips may in many cases be useful. In elements where one of the plates is to form an outer wall or foundation wall, this plate may advantageously be a concrete plate, while the inner plate may for instance consist of gypsum or particle board. Thus, it is not necessary to use the same material in both plates of the element. If the element entirely or partly is made of materials which do not withstand rain or moisture for a shorter or longer period, be it during transport, storage or installation, a waterproof layer, for instance a plastic foil may be arranged on the upper side of the element. Such a foil need not be removed before pouring a concrete cover, except for the holes which must be made before pouring the concrete.

I claim:

1. A building structure comprising a first plate having means attached thereto forming parallel channels, at least some of which are filled with concrete which forms ribs, a second plate disposed parallel to said first plate and attached to the channel forming means, said plates being generally continuous, said ribs being provided with reinforcement, as needed, in any portion of said structure to be subjected to strong tensile loads, and said second plate being provided with a cover of concrete, the concrete in said cover and the concrete in said ribs being connected to each other through holes made in said second plate and forming a monolithic connection between said ribs and said cover.

2. A building structure comprising a first plate having means attached thereto forming parallel channels not more than one third of which are filled with concrete which forms ribs, a second plate disposed parallel to said first plate and attached to the channel forming means, said plates being generally continuous, said ribs being provided with reinforcement, as needed, in any portion of said structure to be subjected to strong tensile loads, and said second plate being provided with a cover of concrete, the concrete in said cover and the concrete in said ribs being connected to each other through holes made in said second plate and forming a monolithic connection between said ribs and said cover.

3. A method of making a building structure comprising a first plate having means attached thereto forming parallel channels at least some of which are filled with concrete which forms ribs, a second plate disposed parallel to said first plate and attached to the channel forming means, said plates being generally continuous, said ribs being provided with reinforcement, as needed, in any portion of said structure to be subjected to strong tensile loads, and said second plate being provided with a cover of concrete, the concrete in said cover and the concrete in said ribs being connected to each other through holes made in said second plate and forming a monolithic connection between said ribs and said cover, said method comprising prefabricating an element generally consisting of said first plate and said second plate disposed parallel with respect to each other and which are attached to means disposed therebetween forming channels, making holes in one of said plates at a predetermined spacing along some of said channels, placing reinforcements, as needed, in some of said channels, and pouring concrete in some of said channels while concurrently covering said second plate with concrete and forming a cover thereon.

4. A method according to claim 3 wherein the holes are made in the plate after the prefabricated element is brought to the building site.

5. A method according to claim 3 wherein the holes are made in the plate after the prefabricated element is disposed in its final place in the building.

6. A method according to claim 3 including placing a shear force reinforcement in the holes before pouring the concrete.

7. A method of making a building structure comprising a first plate having means attached thereto forming parallel channels not more than one third of which are filled with concrete which forms ribs, a second plate disposed parallel to said first plate and attached to the channel forming means, said plates being generally continuous, said ribs being provided with reinforcement, as needed, in any portion of said structure to be subjected to strong tensile loads, and said second plate being provided with a cover of concrete, the concrete in said cover and the concrete in said ribs being connected to each other through holes made in said second plate and forming a monolithic connection between said ribs and said cover, said method comprising prefabricating an element generally consisting of said first plate and said second plate disposed parallel with respect to each other and which are attached to means disposed therebetween forming channels, making holes in one of said plates at a predetermined spacing along some of said channels, placing reinforcements, as needed, in not more than one third of said channels, and pouring concrete in said not more than one third of said channels while concurrently covering said second plate with concrete and forming a cover thereon.

8. A method according to claim 7 wherein the holes are made in the plate after the prefabricated element is brought to the building site.

9. A method according to claim 7 wherein the holes are made in the plate after the prefabricated element is disposed in its final place in the building.

10. A method according to claim 7 including placing a shear force reinforcement in the holes before pouring the concrete.

11. A building element comprising two parallel plates which are attached to means disposed therebetween forming parallel channels, said plates being made of materials selected from the group consisting of gypsum, fiber composites, wood, cement-based materials and gypsum boards, and the channel forming means being made of materials selected from the group consisting of wood, cardboard, plastic metal and corrugated cardboard and one of said plates being provided with weakenings or markings for the formation of holes at a predetermined spacing along at least some of said channels.

12. An element according to claim 11 provided with wooden elements along at least two of its edges.

* * * * *